US005698324A

United States Patent [19]

Jung et al.

[11] Patent Number: 5,698,324

[45] Date of Patent: Dec. 16, 1997

[54] ARAMID FIBERS OF HIGH STRENGTH AND HIGH LINEAR DENSITY, PRODUCTION THEREOF, AND USE THEREOF

[75] Inventors: Holger Jung, Niedernhausen; Jutta Cardinal; Werner Bruckner, both of Kriftel; Richard Neuert, Winkelhaid, all of Germany

[73] Assignee: Hoechst Aktiengesellschaft, Frankfurt, Germany

[21] Appl. No.: 657,008

[22] Filed: May 28, 1996

Related U.S. Application Data

[63] Continuation of Ser. No. 317,764, Oct. 4, 1994, abandoned.

[30] Foreign Application Priority Data

Oct. 6, 1993 [DE] Germany ..... 43 34 004.0

[51] Int. Cl.[6] ..... B32B 27/34

[52] U.S. Cl. ..... 428/395; 428/364; 428/359; 428/378

[58] Field of Search ..... 428/364, 395; 264/183, 210.1, 184, 178 F, 211.14, 210.7, 210.8

[56] References Cited

U.S. PATENT DOCUMENTS

| | | | |
|---|---|---|---|
| 4,034,138 | 7/1977 | Babayan | 428/395 |
| 4,162,346 | 7/1979 | Jones, Jr. et al. | 428/364 |
| 4,507,467 | 3/1985 | Shimada et al. | 528/348 |
| 4,652,488 | 3/1987 | Willensen et al. | 428/395 |
| 4,783,367 | 11/1988 | Maatman et al. | 428/364 |
| 4,835,223 | 5/1989 | Maatman et al. | 525/432 |
| 4,847,354 | 7/1989 | Keil et al. | 528/340 |
| 5,246,776 | 9/1993 | Meraldi et al. | 428/364 |
| 5,334,693 | 8/1994 | Irwin | 428/395 |
| 5,357,031 | 10/1994 | Meiss et al. | 428/395 |
| 5,366,797 | 11/1994 | Rötgers et al. | 428/395 |
| 5,378,538 | 1/1995 | Makino et al. | 428/395 |
| 5,378,800 | 1/1995 | Mok et al. | 428/395 |

FOREIGN PATENT DOCUMENTS

| | | |
|---|---|---|
| 0045934 | 2/1982 | European Pat. Off. . |
| 0199090 | 10/1986 | European Pat. Off. . |
| 0533755 | 8/1993 | European Pat. Off. . |
| 58-9619 | 1/1983 | Japan . |
| WO 91/00381 | 1/1991 | WIPO . |
| WO 92/12018 | 7/1992 | WIPO . |
| WO 92/12279 | 7/1992 | WIPO . |
| WO 92/12285 | 7/1992 | WIPO . |

*Primary Examiner*—Patrick Ryan
*Assistant Examiner*—J. M. Gray
*Attorney, Agent, or Firm*—Connolly & Hutz

[57] ABSTRACT

Fibers having a tenacity of more than 80 cn/tex and a filament linear density of more than 8 dtex which contain as the fiber-forming material an aromatic polyamide which is soluble in organic solvents and spinnable from isotropic spinning solutions. The fibers can be used for example as reinforcing materials, as heat-resistant insulator materials, for producing filter fabrics or as insulating materials.

20 Claims, No Drawings

ARAMID FIBERS OF HIGH STRENGTH AND HIGH LINEAR DENSITY, PRODUCTION THEREOF, AND USE THEREOF

This is a continuation of application Ser. No. 08/317,764, filed Oct. 4, 1994, which is now abandoned.

BACKGROUND OF THE INVENTION

1. Field of the Invention

The present invention relates to fibers comprising selected aromatic polyamides of high strength and high linear densities, processes for the production thereof, and the use thereof, in particular for producing fiber-reinforced composite materials.

2. Description of the Related Art

Aromatic polyamides, also known as aramids, are known fiber-forming materials of high chemical resistance. Aramid fibers are notable in particular for good mechanical properties, such as high strengths and moduli.

Aramid fibers of high linear density are known. For instance, WO-A-91/381 describes aramid fibers having linear densities of more than 1.7 tex. Further coarse linear density fibers composed of aramids are known from WO-A-92/12,279. WO-A-92/12,018 describes reinforced composites containing such fibers, and WO-A-92/12,285 discloses a process for the plasma treatment of coarse linear density aramid monofilaments. All these publications describe fibers composed of aramids which are spun from anisotropic solutions. A typical representative of such aramids is poly (p-phenyleneterephthalamide). Aramids of this type can only be spun under inconvenient conditions, for example from solutions of the aramid in concentrated sulfuric acid.

A further method of producing coarse linear density aramid fibers is known from JP-A-58-9,619. The fibers described therein are produced by melt spinning and consist of poly(m-phenyleneisophthalamide). The strength values of such fibers still leave something to be desired.

The production of coarse linear density para-aramid fibers spun from isotropic solutions has hitherto not been disclosed. It has now been found that such fibers are simple to produce by solution spinning and that the fibers obtained are notable for high strength values.

SUMMARY OF THE INVENTION

The present invention relates to fibers having a tenacity of more than 80 cN/tex and a filament linear density of more than 8 dtex and comprising as fiber-forming material an aromatic polyamide which is soluble in organic solvents and spinnable from isotropic spinning solutions.

The term "fiber" is to be understood in the context of this invention in its widest sense, provided the fiber in question is a coarse linear density fiber; fiber as used herein thus includes for example endless, continuous filament fibers, such as monofilaments or multifilaments, staple fibers, preferably having staple lengths of from 0.5 to 50 mm, and pulp.

DESCRIPTION OF THE PREFERRED EMBODIMENTS

Preferably the filament linear density of the fibers according to the invention is from 8 to 50 dtex, in particular from 10 to 30 dtex.

Preferably the tenacity of the fibers according to the invention is from 130 to 260 cN/tex, preferably from 150 to 205 cN/tex.

The fibers of the invention have as a consequence of the high strength a low breaking extension, for example a breaking extension of less than 10%, preferably a breaking extension of from 4 to 5%.

The modulus of elasticity of the fibers according to the invention is customarily high, the initial modulus is for example more than 30 N/tex, preferably from 30 to 80 N/rex, based on 100% extension.

In a particularly preferred embodiment, the filament linear density of the fibers according to the invention is very uniform. The linear density uniformity of multifilament yarns or of monofilaments is expressed by the USTER value (DIN 53 817). To determine this value, fiber assemblies or monofilaments are passed through a measuring element which transforms the mass fluctuations of the fiber assembly or of the monofilament into a proportional electric signal. A measure of the mass fluctuations is the variation coefficient (cV value). It is defined as the ratio of the standard deviation s of the mass fluctuations to the mean X of the mass of the fiber assembly ($cV=s/X*100\%$). The cV value is ideally in the case of the round cross section 1.0% (apparatus-specific).

The fibers of the invention preferably have cV values between 1.0 and 6.0% (measured by means of the ®USTER tester 2-C from Zellweger-Uster AG, Uster, Switzerland), in particular cV values of from 1.8 to 5.0%.

The cross-sectional shape of the individual filaments of the fibers according to the invention can be any shape desired, for example triangular, tri- or multilobal or in particular elliptical or round. It is also possible to produce hollow fibers.

Suitable aramids for use in the production of fibers according to the invention include any aramid which is soluble in organic solvents, provided it forms isotropic solutions.

A soluble aromatic polyamide is for the purposes of the present invention an aromatic polyamide which has a solubility in N-methylpyrrolidone of at least 50 g/l at 25° C.

An aromatic polyamide which forms isotropic solutions is for the purposes of this invention a polymer which forms isotropic solutions in an organic solvent or a mixture of such solvents at 25° C.

Preference is given to using aromatic polyamides which are soluble in polar aprotic solvents with the formation of isotropic solutions and which contain at least two, in particular three, different repeating structural units which differ in the diamine units.

Preferably the aramid is a polymer with the repeating structural units of the formulae I, II and optionally III

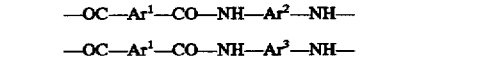

$$—OC—Ar^1—CO—NH—Ar^2—NH— \quad (I),$$

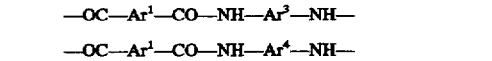

$$—OC—Ar^1—CO—NH—Ar^3—NH— \quad (II),$$

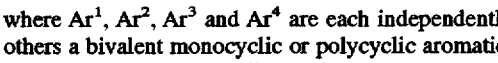

$$—OC—Ar^1—CO—NH—Ar^4—NH— \quad (III),$$

where $Ar^1$, $Ar^2$, $Ar^3$ and $Ar^4$ are each independently of the others a bivalent monocyclic or polycyclic aromatic radical whose free valences are disposed para or meta or comparably parallel, coaxial or kinked to each other, and $Ar^2$, $Ar^3$ and, if present, $Ar^4$ each have different individual meanings within the scope of the given definitions, and the respective monomer building blocks underlying the polymer are selected so as to produce an aromatic polyamide which is soluble in organic solvents and forms isotropic solutions.

Any bivalent aromatic radicals whose valence bonds are disposed para or comparably coaxial or parallel to each other are monocyclic or polycyclic aromatic hydrocarbon radicals or heterocyclic aromatic radicals which can be monocyclic or polycyclic. Heterocyclic aromatic radicals have in particular one or two oxygen, nitrogen or sulfur atoms in the aromatic nucleus.

Polycyclic aromatic radicals can be fused to one another or be bonded linearly to one another via C—C bonds or via —CO—NH— groups.

The valence bonds in mutually coaxial or parallel disposition point in opposite directions. An example of coaxial bonds pointing in opposite directions are the biphenyl-4,4'-ylene bonds. An example of parallel bonds pointing in opposite directions are the naphthylene-1,5 or -2,6 bonds, whereas the naphthylene-1,8 bonds are parallel but point in the same direction.

Examples of preferred bivalent aromatic radicals whose valence bonds are disposed para or comparably coaxial or parallel to each other are monocyclic aromatic radicals having free valences disposed pard to each other, especially 1,4-phenylene, or bicyclic fused aromatic radicals having parallel bonds pointing in opposite directions, especially 1,4-, 1,5- and 2,6-naphthylene, or bicyclic aromatic radicals linked by a C—C bond and having coaxial bonds pointing in opposite directions, especially 4,4'-biphenylylene.

Any bivalent aromatic radicals whose valence bonds are disposed meta or comparably kinked to each other are monocyclic or polycyclic aromatic hydrocarbon radicals or heterocyclic aromatic radicals which can be monocyclic or polycyclic. Heterocyclic aromatic radicals have in particular one or two oxygen, nitrogen or sulfur atoms in the aromatic nucleus.

Polycyclic aromatic radicals can be fused to one another or be bonded to one another via C—C bonds or via bridging groups such as —O—, —$CH_2$—, —S—, —CO— or —$SO_2$—.

Examples of preferred bivalent aromatic radicals whose valence bonds are disposed meta or comparably kinked to each other are monocyclic aromatic radicals having free valences disposed meta to each other, especially 1,3-phenylene, or bicyclic fused aromatic radicals having mutually kinked bonds, especially 1,6- and 2,7-naphthylens, or bicyclic aromatic radicals linked via a C—C bond but having mutually kinked bonds, especially 3,4'-biphenylylene.

Minor portions, for example up to 5 mol %, of the monomer units, based on the polymer, can be aliphatic or cycloaliphatic in nature, for example alkylene or cycloalkylene units.

Alkylene is to be understood as meaning branched and especially straight-chain alkylene, for example alkylene having two to four carbon atoms, especially ethylene.

Cycloalkylene radicals are for example radicals having five to eight carbon atoms, especially cyclobexylene.

All these aliphatic, cycloaliphatic or aromatic radicals can be substituted by inert groups. These are substituents which have no adverse effect on the contemplated application.

Examples of such substituents are alkyl, alkoxy or halogen.

Alkyl is to be understood as meaning branched and especially straight-chain alkyl, for example alkyl having one to six carbon atoms, especially methyl.

Alkoxy is to be understood as meaning branched and especially straight-chain alkoxy, for example alkoxy having one to six carbon atoms, especially methoxy.

Halogen is for example fluorine, bromine or in particular chlorine.

Preference is given to aromatic polyamides based on unsubstituted radicals.

The dicarboxylic acid unit in the aromatic polyamides comprising the repeating structural units of the formulae I, II and optionally III is preferably terephthalic acid.

Examples of preferred diamine combinations from which these preferred repeating structural units of the formulae I, II and III are derived are 1,4-phenylenediamine, 4,4'-diaminodiphenylmethane and 3,3'-dichloro-, 3,3'-dimethyl- or 3,3'-dimethoxybenzidines also 1,4-phenylenediamine, 1,4-bis(aminophenoxy)benzene and 3,3'-dichloro-, 3,3'-dimethyl- or 3,3'-dimethoxybenzidine; and also 1,4-phenylenediamine, 3,4'-diaminodiphenyl ether and 3,3'-dichloro-, 3,3'-dimethyl- or 3,3'-dimethoxybenzidine; and also 1,4-phenylenediamine, 3,4'-diaminodiphenyl ether and 4,4'-diaminobenzanilide; and also 1,4-phenylenediamine, 1,4-bis(aminophenoxy)benzene and 3,4'-diaminodiphenyl ether.

Aramids which are derived from such diamine combinations and which are preferably for use according to the present invention are described in EP-A-199,090, EP-A-364,891, EP-A-394,892, EP-A-394,893 and EP-A-424,860.

The aromatic polyamides to be used according to the invention are known per se and can be prepared by methods known per se.

Preference is given to using aromatic polyamides with the above-defined repeating structural units of the formulae I, II and optionally III where $Ar^1$ is a bivalent monocyclic or polycyclic aromatic radical whose free valences are disposed para or comparably parallel or coaxial to each other, $Ar^2$ is a bivalent monocyclic or polycyclic aromatic radical whose free valences are disposed para or comparably parallel or coaxial to each other, $Ar^3$ is a radical of the formula IV $$—Ar^5—X—Ar^6— \quad (IV),$$

where $Ar^5$ and $Ar^6$ are each independently of the other a bivalent monocyclic or polycyclic aromatic radical whose free valences are disposed para or comparably parallel or coaxial to each other or where $Ar^6$ additionally is a bivalent monocyclic or polycyclic aromatic radical whose free valences are disposed meta or comparably kinked to each other, X is a group of the formula —O—, —S—, —$SO_2$—, —O-phenylene-O— or alkylene, and where $Ar^4$ has one of the meanings defined for $Ar^2$ or $Ar^3$ but differs from the particular $Ar^2$ or $Ar^3$ of a molecule.

Particularly preferred aramids of this type are polymers where $Ar^1$ is 1,4-phenylene, $Ar^2$ is 1,4-phenylene or a bivalent radical of 4,4'-diaminobenzanilide, $Ar^5$ and $Ar^6$ are each 1,4-phenylene, X is —O—, —$CH_2$— or —O-1,4-phenylene-O—, and $Ar^4$ is a bivalent radical of 3,4'-diaminodiphenyl ether, of 3,3'-dichlorobenzidine, of 3,3'-dimethylbenzidine or of 3,3'-dimethoxybenzidine.

The polycondensation of aromatic polyamides to be spun according to the invention is generally carried out as a solution polymerization.

For this the aromatic monomeric compounds to be reacted with one another are generally dissolved in an organic solvent. The organic solvent preferably comprises at least one solvent of the amide type, for example N-methyl-2-pyrrolidone, N,N-dimethylacetamide, tetramethylurea, N-methyl-2-piperidone, N,N'-dimethylethyleneurea, N,N,N',N'-tetramethylmaleamide, N-methylcaprolactam, N-acetylpyrrolidine, N,N-diethylacetamide, N-ethyl-2-pyrrolidone, N,N'-dimethylpropionamide, N,N-dimethylisobutylamide, N-methylformamide, N,N'-dimethylpropyleneurea. The preferred organic solvents for the process of the invention are N-methyl-2-pyrrolidone, N,N-dimethylacetamide and a mixture thereof.

In a preferred embodiment of the solution polymerization, the aromatic monomeric diamines are dissolved in an amide solvent. The solution thus obtained is then mixed with the at least one aromatic monomeric compound in the form of an aromatic dicarbonyl dihalide by vigorous stirring to initiate the polycondensation.

In this process, the amide solvent is used not only as solvent for the aromatic monomeric compounds and the aromatic copolyamide obtained therefrom but also as acid acceptor for a hydrogen halide, for example for hydrogen chloride, which is formed as a by-product of the copolymerization of the aromatic monomeric compounds. In some cases it can be advantageous to use a solubility-promoting additive, for example a metal halide of one of the metals of group I or II of the periodic table, which is added to the polycondensation mixture before, during or after the polycondensation.

Examples of such additives are alkali metal halides, such as lithium chloride, or alkaline earth metal halides, such as calcium chloride.

The polycondensation temperatures for a solution polymerization are customarily between −20° C. and +120° C., preferably between +10° C. and +100° C. Particularly good results are obtained at reaction temperatures between +10° C. and +80° C.

The sum of the concentrations of the aromatic monomer compounds in the polycondensation mixture solution can be set having regard to the desired degree of polycondensation, the viscosity desired for the polycondensation mixture, the nature of the aromatic monomer compounds used, the nature of the solvent used and the desired polycondensation temperature. Which is the most favorable sum of the concentrations can be determined on the basis of a series of preliminary experiments on the course of the polycondensation.

Polycondensation reactions are preferably carried out so that, after the reaction has ended, from 2 to 15, preferably from 3 to 12%, by weight of polycondensate are present in the solution. Particularly good results are obtained with concentrations of from 4 to 6% by weight.

In the course of the polycondensation, the molecular weight of the polymer increases, and so does the viscosity of the reaction batch.

An adequate molecular chain length has been reached when the viscosity of the polymer solution obtained in the course of the polycondensation corresponds to an inherent viscosity of the polymer of more than 3.0 dl/g, preferably more than 5.0 dl/g, in particular from 4.5 to 8.0 dl/g.

By inherent viscosity is meant the expression:

$$\eta_{inh} = \frac{\ln \eta_{rel}}{c} .$$

where $\eta_{rel}$ is the relative viscosity and c is the concentration in g/100 ml.

For the purposes of the present invention, the inherent viscosity is determined on solutions of 0.25% of polymer in N-methylpyrrolidone at 25° C.

Once the polymer solution has reached the viscosity required for further processing, the polycondensation can be terminated in conventional manner by addition of monofunctional compounds, e.g. acetyl chloride. Then the hydrogen chloride formed, which is present as a salt with the amide solvent, can be neutralized through the addition of basic substances.

Suitable for the purpose are for example lithium hydroxide, calciumhydroxide, but in particular calcium oxide.

The aromatic polyamide obtained on carrying out the production process can be collected from the polycondensation mixture by a separating process, for example by precipitation. To produce a solution for extruding the copolyamide, the aromatic polyamide thus isolated is then dissolved in a suitable organic solvent.

In those cases where the aromatic polyamide was prepared using the method of solution polycondensation, the polyamide, being highly soluble in the solvent used for the polycondensation, is, however, completely dissolved therein. In an industrial use of the production process it is therefore advantageous to use the mixture obtained in the polycondensation directly as spinning solution for the aromatic polyamide.

In the process for preparing the spinning solution of the aromatic polyamide, the solvent used is preferably of the amide type, in particular one of the abovementioned solvents of the amide type or a mixture of two or more of said compounds.

To prepare the spinning solution it is advantageous to maintain the concentration of the aromatic polyamide within the range between 3 and 12% by weight, in particular between 4 and 6% by weight. If necessary, the spinning solution may contain a solubility-promoting additive, in which case at least one metal halide of a metal of groups I and II of the periodic table can be used, for example lithium chloride, calcium chloride or magnesium bromide, and in a concentration between 0.2 and 10%, preferably between 0.5 and 5%, based on the total weight of the spinning solution. This solubility-promoting additive also enhances the stability of the spinning solution at elevated temperature.

The spinning of the spinning solution to form the fibers of the invention can be carried out by any suitable dry process, wet process or dry-wet process. In those cases where a wet process is used, the spinning solution is extruded through a spinneret into a coagulating liquid.

It is usually advantageous in this connection for the coagulating liquid to comprise water or a water-containing solution of a polar organic solvent. This polar organic solvent can be selected from the same amide solvents which are usually used for dissolving the aromatic polyamide.

The polar organic solvent used in the coagulation liquid is preferably the same solvent as is present in the forming solution. The coagulation liquid is preferably used at a temperature between 0° C. and the boiling point of the coagulation liquid at atmospheric pressure.

The polar organic solvent is preferably present in the coagulation liquid in a concentration of less than 70% by weight, in particular less than 50% by weight.

In the production of fibers from the aromatic polyamide, the spinning solution is extruded through a spinning pack having one or more orifices, the filamentary streams of the spinning solution being solidified in one of the above-indicated coagulation liquids (wet process) or in an evaporation-promoting atmosphere (dry process). A similarly useful variant is the dry jet-wet spinning process as described for example in U.S. Pat. No. 3,414,645. The spinning apparatus used can be a customary horizontal or vertical wet spinning machine, a dry jet-wet spinning machine or a spinning machine in which the material flows downward under tension.

The size of the holes in the spinneret must be chosen so as to produce a filament of the desired linear density. The spinnerets used customarily have hole diameters of from 0.1 to 1.0 mm. These spinnerets can have single holes (for the production of monofilaments) or else a plurality of holes (for the production of multifilaments).

In the production of fibers according to the invention which have a particularly uniform linear density, the viscosity of the spinning solution must be so adjusted as to make it possible for the spinning pump to produce a particularly uniform flow rate.

In the wet spinning of an aromatic polyamide according to the invention, the coagulation is preferably effected using a coagulation liquid comprising a coagulation-promoting additive, and this coagulation is followed by a further coagulation step whereby the coagulating filaments of the aromatic copolyamide are passed into a waterbath maintained at a temperature between 0° and 100° C.

The additional coagulation step serves to complete the coagulation by removing the solvent. Moreover, the coagulation-promoting additives, if such substances are used, are washed out of the coagulated filaments.

It is clear from the foregoing that the aromatic polyamide of the invention is easy to process into filaments using customary spinning processes and apparatus without having to use a dangerous or harmful solvent such as concentrated sulfuric acid.

This reduces the risks to the operating personnel. Moreover, the filaments produced from the copolyamide of the invention have a dense internal structure.

The filaments produced according to the invention are usually subjected to a drawing process which promotes not only the mechanical properties, for example the tensile strength and the modulus of elasticity, but also the thermal properties, for example the thermal stability, of the fibers thus produced.

Filaments are generally drawn to obtain a high mechanical strength and a high modulus of elasticity. The draw ratio employed customarily ranges from about 1:6 to 1:20. The drawing temperature is generally between 250° and 500° C., preferably between 300° and 480° C.

Drawing can be carried out in a single or in two or more steps, and a hotplate or a cylindrical heater can be used. In addition, the drawn filaments can be subjected to a further heat treatment at the same or at a higher temperature in order that their crystalline structure may be enhanced. The fibers of the invention are notable for high breaking strengths and initial moduli and for low breaking extensions.

The present invention also provides a process for producing the fibers of the invention, comprising the steps of:

a) preparing an isotropic spinning solution comprising an organic solvent and at least one aromatic polyamide which is soluble in organic solvents,
b) extruding the spinning solution through a spinneret which contains orifices in a predetermined number and shape so as to produce a fiber of the desired filament linear density,
c) removing the organic solvent in a manner known per se so as to produce solvent-reduced or -free filaments of adequate mechanical stability and non-tackiness for further processing, and
d) drawing the resulting filaments in a manner known per se.

Step c) can comprise evaporating the solvent using elevated temperature to form a reduced-solvent formed structure of adequate mechanical stability and non-tackiness for further processing (dry forming process).

Preferably the initial structure formed is introduced in step c) into a bath comprising a coagulation liquid so that the organic solvent is removed from said initial formed structure and the desired formed structure is produced by coagulation of the initial structure and has adequate mechanical stability for further processing (wet forming process).

The introducing can be effected by direct extruding into a coagulation liquid or by extruding into a coagulation liquid after passage through an airgap of predetermined length.

The fibers of the invention, which have excellent mechanical and thermal properties and are notable for high drawability, can be used in industry in a wide variety of ways, for example as reinforcing materials, for example for the reinforcement of car tires and other rubber articles and in particular for the reinforcement of hydraulically setting materials, as heat-resistant insulator materials, for producing filter fabrics and as insulating materials.

Further properties and advantages of the invention will now be more particularly described by way of example.

It is to be understood, however, that the invention is not restricted to the embodiment examples. On the contrary, the person skilled in the art has on the basis of the embodiment examples numerous possibilities for modifications and/or additions at his or her disposal without having to depart from the basic concept of the invention.

EXAMPLE 1

An aromatic polyamide based on terephthaloyl dichloride, 25 mol % of para-phenylenediamine, 50 mol % of 3,3'-dimethylbenzidine and 25 mol % of 1,4-bis(4-aminophenoxy)benzene is prepared by solution polycondensation in NMP so that the solution has an inherent viscosity of about 6 dl/g. The polymer solution obtained is directly spun through a 10 hole spinneret by the wet spinning process. The spinneret hole diameters range from 150 to 300 μm. The filaments are precipitated in an aqueous coagulation bath containing 35% by weight of NMP at 80° C. and subsequently washed at 80° C. in two waterbaths and a washer. During the wash a drawing operation is effected by means of inlet and outlet godeta turning at different speeds (14 m/min and 16 m/min, respectively). Then the filaments are guided over a dry godet and finally over a hotplate at temperatures of 490° to 430° C. and drawn to a 19-fold multiple.

The filament linear density of the filaments obtained is 10 dtex. The filaments have the following mechanical properties:

Tenacity: 133 cN/tex
Initial modulus: 66 N/tex
Breaking extension: 2.1%

EXAMPLE 2

An aromatic polyamide based on terephthaloyl dichloride, 50 mol % of para-phenylenediamine, 35 mol % of 3,4'-diaminodiphenyl ether and 15 mol % of 1,4-bis(4-aminophenoxy)benzene is prepared by solution polycondensation in NMP so that the solution has an inherent viscosity of about 5 dl/g. The polymer solution obtained is directly spun through a I hole spinneret by the wet spinning process. The spinneret hole diameter ranges from 150 to 300 μm. The filament is precipitated in an aqueous coagulation bath containing 35% by weight of NMP at 80° C. and subsequently washed at 80° C. in two waterbaths and a washer. During the wash a drawing operation is effected by means of inlet and outlet godets turning at different speeds (14 m/min and 16 m/min, respectively). Then the filament is guided over a dry godet and finally over a hotplate at temperatures of 400° to 480° C. and drawn to a 12-fold multiple.

The filament has the following mechanical properties:

Tenacity: 203 cN/tex
Initial modulus: 51 N/tex
Breaking extension: 4.1%

What is claimed is:

1. A fiber comprising a filament and said filament is endless, continuous filament, monofilament or multifilament and said fiber has a linear density of more than 8 dtex and said fiber a variation coefficient (cV value) between 1.0 and 6.0% and comprising as fiber-forming material an aromatic polyamide spinnable from isotropic spinning solutions and said aromatic polyamide is a polymer with the repeating structural units of the formula I and II and optionally III $$—OC—Ar^1—CO—NH—Ar^2—NH— \quad (I),$$

$$—OC—Ar^1—CO—NH—Ar^3—NH— \quad (II),$$

$$—OC—Ar^1—CO—NH—Ar^4—NH— \quad (III),$$

where $Ar^1$, $Ar^2$, $Ar^3$ and $Ar^4$ are each independently of the others a bivalent monocyclic or polycyclic aromatic radical, and $Ar^2$, $Ar^3$ and, if present, $Ar^4$ each have different individual meanings within the scope of the given definitions, and the respective monomer building blocks underlying the polymer are selected so as to produce an aromatic polyamide which is soluble in organic solvents and forms isotropic solutions.

2. The fiber of claim 1, wherein said filament has a linear density of from 8 to 50 dtex.

3. The fiber of claim 1, wherein said filament has it linear density of from 10 to 30 dtex.

4. The fiber of claim 1, having a tenacity of the fibers from 130 to 260 cN/tex.

5. The fiber of claim 1, having a tenacity of the fibers from 150 to 205 cN/tex.

6. The fiber of claim 1, having a tenacity of the fibers from 150 cN/tex to 260 cN/tex and a breaking extension of from 4 to 5%.

7. The fiber of claim 1, wherein the fibers have an initial modulus of elasticity, based on 100% extension, of from 30 to 80 N/tex.

8. The fiber of claim 1, wherein $Ar^1$ is a bivalent monocyclic or polycyclic aromatic radical whose free valences are disposed para or comparably parallel or coaxial to each other, $Ar^2$ is a bivalent monocyclic or polycyclic aromatic radical whose free valences are disposed para or comparably parallel or coaxial to each other, $Ar^3$ is a radical of the formula IV $$—Ar^5—X—Ar^6— \quad (IV),$$

where $Ar^5$ and $Ar^6$ are each independently of the other a bivalent monocyclic or polycyclic aromatic radical whose free valences are disposed para or comparably parallel or coaxial to each other or where $Ar^6$ additionally is a bivalent monocyclic or polycyclic aromatic radical whose free valences are disposed meta or comparably kinked to each other, X is selected from the group Consisting of the formula —O—, —S—, —$SO_2$—, —O-phenylene-O— and alkylene, and $Ar^4$ is a bivalent monocyclic or polycyclic aromatic radical whose free valences are disposgl para or comparably parallel or coaxial to each other: or is a radical of the formula IV $$—Ar^5—X—Ar^6— \quad (IV),$$

wherein $Ar^5$ and $Ar^6$ are defined above, and with the proviso that $Ar^4$ is different from $Ar^2$ or $Ar^3$.

9. The fiber of claim 8 wherein $Ar^1$ is 1,4 phenylene, $Ar^2$ is 1,4-phenylene or a bivalent radical of 4,4'-diaminobenzanilide, $Ar^5$ and $Ar^6$ are each 1,4 phenylene, X is —O—, —$CH_2$— or —O-1,4-phenylene-O—, and $Ar^4$ is a bivalent radical of (a) 3,4'-diaminodiphenyl ether, (b) 3,3'-dichlorobenzidine (c) 3,3'-dimethylbenzidine or (d) 3,3'-dimethoxybenzidine.

10. The fiber as claimed in claim 1, wherein said fiber has a tenacity from 203 to 260 cN/tex.

11. The fiber as claimed in claim 1, wherein said aromatic polyamide consist of a polymer with the regenting structural units of the formula I and II and optionally III $$—OC—Ar^1—CO—NH—Ar^2—NH— \quad (I),$$

$$—OC—Ar^1—CO—NH—Ar^3—NH— \quad (II),$$

$$—OC—Ar^1—CO—NH—Ar^4—NH— \quad (III),$$

where $Ar^1$, $Ar^2$, $Ar^3$ and $Ar^4$ are each independently of the others a bivalent monocyclic or polycyclic aromatic radical whose free valences are disposed para or meta or comparably parallel, coaxial or kinked to each other, and $Ar^2$, $Ar^3$ and, if present, $Ar^4$ each have different individual meanings within the scope of the given definitions, and the respective monomer building blocks underlying the polymer are selected so as to produce an aromatic polyamide which is soluble in organic solvents and forms isotropic solutions.

12. The fiber as chimed in claim 1, wherein said fiber has a tenacity of more than 80 cN/tex.

13. The fiber as claimed in claim 1, wherein said fiber has a tenacity of 150 to 205 cN/tex.

14. The fiber as claimed in claim 1, wherein said fiber is a copolymer of formulas (I) and (II).

15. The fiber of claim 1, wherein said fiber is a monofilament or multifilament yarn with a variation coefficient (cV value) between 1.0 and 6.0%.

16. The fiber as claimed in claim 15, wherein said variation coefficient is between 1.8 and 5%.

17. A fiber comprising a filament and said filament is endless, continuous filament, monofilament or multifilament and has a filament linear density of the fiber of more than 8 dtex and comprising as fiber-forming material an aromatic polyamide which is soluble in organic solvents and spinnable from isotropic spinning solutions and said fiber has a uniform linear density.

18. The fiber as claimed in claim 17, wherein said aromatic polyamide consists of a polymer with the repeating structural units of the formula I and II and optionally III $$—OC—Ar^1—CO—NH—Ar^2—NH— \quad (I),$$

$$—OC—Ar^1—CO—NH—Ar^3—NH— \quad (II),$$

$$—OC—Ar^1—CO—NH—Ar^4—NH— \quad (III),$$

where $Ar^1$, $Ar^2$, $Ar^3$ and $Ar^4$ are each independently of the others a bivalent monocyclic or polycyclic aromatic radical whose free valences are disposed para or meta or comparably parallel, coaxial or kinked to each other, and $Ar^2$, $Ar^3$ and, if present, $Ar^4$ each have different individual meanings within the scope of the given definitions, and the respective monomer building blocks underlying the polymer are selected so as to produce an aromatic polyamide which is soluble in organic solvents and forms isotropic solutions.

19. The fiber as chimed in claim 18, wherein said fiber is a monofilament or multifilament yarn with a linear density uniformity having a variation coefficient value) between 1.8 and 5.0%.

20. The fiber as claimed in claim 17, wherein said fiber is a monofilament or multifilament yarn with a linear density uniformity having a variation coefficient (cV value) between 1.0 and 6.0%.

* * * * *